US006617951B2

(12) United States Patent
Wang

(10) Patent No.: US 6,617,951 B2
(45) Date of Patent: Sep. 9, 2003

(54) SAFETY SWITCH

(75) Inventor: Ming-Shan Wang, Taipei (TW)

(73) Assignee: Tsung-Mou Yu, Panchiao (TW)

( * ) Notice: Subject to any disclaimer, the term of this patent is extended or adjusted under 35 U.S.C. 154(b) by 0 days.

(21) Appl. No.: 09/939,118

(22) Filed: Aug. 24, 2001

(65) Prior Publication Data

US 2003/0038701 A1 Feb. 27, 2003

(51) Int. Cl.[7] ..... H01H 71/58; H01H 71/54

(52) U.S. Cl. ..... 337/37; 337/66; 337/75; 337/89

(58) Field of Search ..... 337/1, 3, 12–14, 337/16, 36, 37, 53, 59, 62, 66, 68, 72, 75, 85, 89, 101, 111, 112, 113, 140

(56) References Cited

U.S. PATENT DOCUMENTS

| | | | | | |
|---|---|---|---|---|---|
| 2,148,880 | A | * | 2/1939 | Sattler | 337/59 |
| 2,911,503 | A | * | 11/1959 | Garbers | 337/56 |
| 4,371,859 | A | * | 2/1983 | Sorimachi | 337/365 |
| 5,262,748 | A | | 11/1993 | Tsung-Mou | 337/66 |
| 5,539,371 | A | * | 7/1996 | Yu | 337/66 |
| 5,760,672 | A | | 6/1998 | Wang | 337/79 |
| 5,828,284 | A | * | 10/1998 | Huang | 337/37 |
| 5,933,069 | A | * | 8/1999 | Huang | 337/66 |
| 6,072,381 | A | * | 6/2000 | Yu | 337/37 |
| 6,400,250 | B1 | * | 6/2002 | Wang | 337/66 |
| 6,452,125 | B1 | * | 9/2002 | Yu | 200/553 |

FOREIGN PATENT DOCUMENTS

| | | | | | |
|---|---|---|---|---|---|
| EP | 496643 | A1 | * | 7/1992 | H01H/73/30 |
| GB | 2063566 | A | * | 6/1981 | H01H/73/50 |

* cited by examiner

*Primary Examiner*—Anatoly Vortman

(57) ABSTRACT

A safety switch includes a casing having a first terminal plate having a first contact point and a second terminal plate to which an end of a bi-metal plate is connected. A second contact point is connected to the bi-metal plate. A movable member is movably engaged with the casing and has two protrusions from an inside of the movable member. The other end of the bi-metal plate is movably located between the two protrusions. The movable member can be easily connected with different types of switch members.

6 Claims, 19 Drawing Sheets

SAFETY SWITCH

FIELD OF THE INVENTION

The present invention relates to a safety switch that has a bi-metal plate which has an end movably engaged with a gap defined in a switch member so that even if the switch member is stuck, the bi-metal plate is deformed when the switch is overridden.

BACKGROUND OF THE INVENTION

A conventional see-saw switch is shown in FIG. 1 and includes a switch member 11 having a protrusion 110 which movably presses a plate 12 so that two contacts on two ends of the plate 12 can be respectively pushed to contact a corresponding contact point. This type of switch cannot automatically jump off when it is overridden. FIGS. 2A and 2B show a switch disclosed in U.S. Pat. No. 5,262,748 that includes a switch member 13 which has one end connected to a connection plate 14 which is connected to a bi-metal plate 170. A curve resilient plate 18 has one end connected to the easing 10 of the switch device and the other end connected to one end of the bi-metal plate 170. Three terminal plates 15, 16, 17 are connected to the casing 10 of the switch device and the bi-metal plate 170 has the other end thereof connected to the terminal plate 17. A contact point 171 is connected on the bi-metal plate 170 and another contact point 160 is connected to the terminal plate 16. The bi-metal plate 170 is lowered by pushing the switch member 13 to close the circuit. When the switch is overridden, the bi-metal plate 170 is deformed to separate the two contact points 171, 160. However, if the switch member 13 is stuck or if the resilient plate 18 fails, the bi-metal plate 170 will not be deformed. Besides, if the deformation force of the bi-metal plate 170 is larger than the force of the resilient plate 18, the resilient plate 18 will keep the bi-metal plate 170 at an open status. If the users push the switch member 13 again, the bi-metal plate 170 will jump off again, and this could result in sparks and has potential danger.

FIGS. 3A and 3B show a Taiwanese published patent No. 334165 that includes a switch 20 with a driving member 21 which is slidably engaged with a connection member 22. A spring 24 is connected between the driving member 21 and an inside of the casing of the switch device. A bi-metal plate 23 has one end thereof fixed to one of two terminal plates of the casing and the other end of the bi-metal plate 23 is engaged with the connection member 22. The bi-metal plate 23 contacts the other terminal plate when the switch member 20 is pushed. When current overrides, the bi-metal plate 23 is deformed and pushes the driving member 21 to let a convex portion of the driving member 21 engage with a recess 25 defined in an inside of the casing, and the bi-metal plate 23 is separated from the terminal plate. When either one of the switch member 20, the driving member 21 or the connection member 22 is out of order or stuck, the circuit cannot be opened. If the spring force 24 is too large, then the bi-metal plate 23 cannot jump off from the terminal plate, and if the spring force 24 is too small, then the bi-metal plate 23 could jump off often.

FIGS. 4A, 4B and 4C show a switch device disclosed in U.S. Pat. No. 5,760,672 that includes a switch member 28 which has one end connected to a connection plate 26 which has a hook portion for receiving an end of a bi-metal plate 27. Three terminal plates are connected to the casing of the switch device and a contact point 271 on the bi-metal plate 27 is to contact another contact point 272 on one of the terminal plates. A gap AS is defined in the hook portion so as to allow the bi-metal plate 27 to be deformed. However, this type of switch can only used with a specific type of see-saw switch member. Besides, because the switch member 28, the connection member 26 and the bi-metal plate 27 are normally engaged with each other, if any one of the parts is stuck or out of order, the bi-metal plate 27 could not jump off when the temperature drops, the deformed bi-metal plate 27 will contact the contact point 272 again. Because the overridden situation is not released, the circuit will be opened and closed repeatedly.

SUMMARY OF THE INVENTION

In accordance with one aspect of the present invention, there is provided a safety switch which comprises a casing having a first terminal plate and a second terminal plate. A first contact point is connected to the first terminal plate and a bi-metal plate is fixedly connected to the second terminal plate. A second contact point is connected to the bi-metal plate. A movable member is movably engaged with the casing and has two protrusions extending from an inside of the movable member. A free end of the bi-metal plate is movably located between the two protrusions.

The primary object of the present invention is to provide a safety switch device wherein the bi-metal plate is deformed even if the switch member is stuck.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
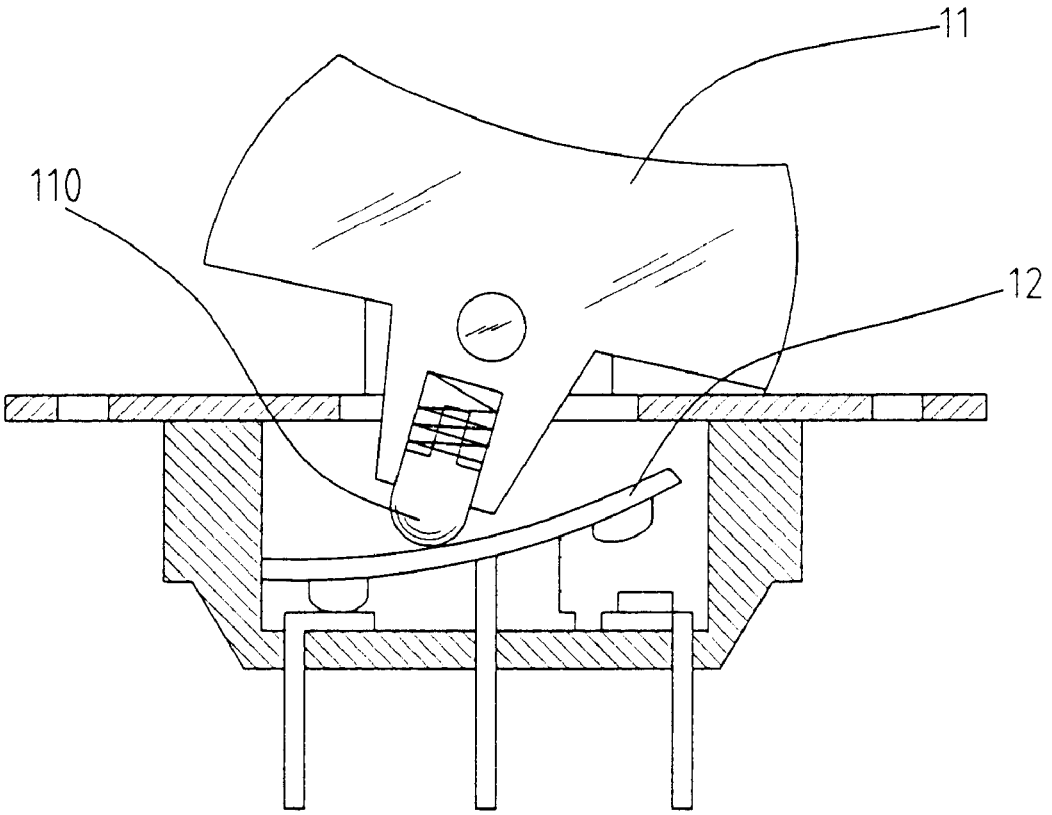
FIG. 1 PRIOR ART
FIG. 1 is a cross sectional view to show a see-saw type switch device.
Figure 2A:
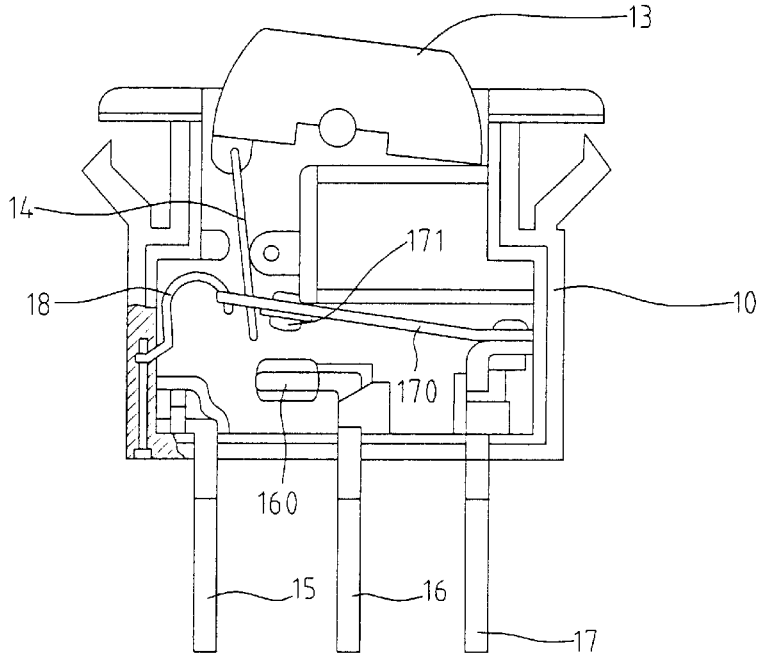
FIG. 2A PRIOR ART
FIGS. 2A and 2B show the open status and the close status of a switch device disclosed in U.S. Pat. No. 5,262,748.
Figure 2B:
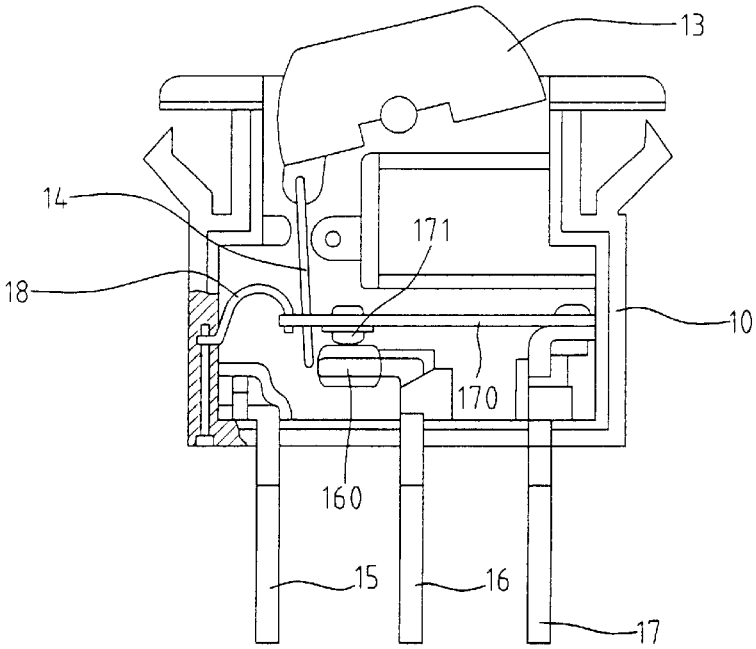
FIG. 2B PRIOR ART
Figure 3A:
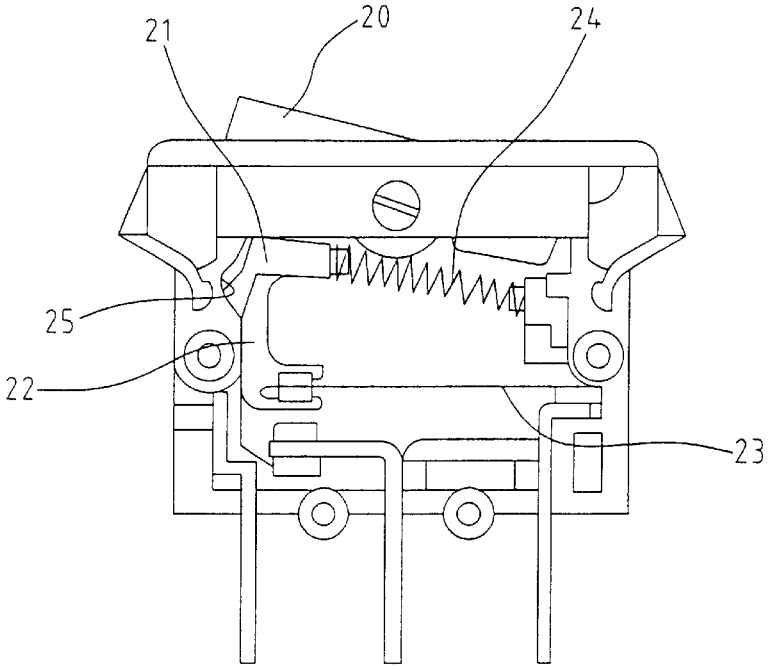
FIG. 3A PRIOR ART
FIGS. 3A and 3B show the open status and the close status of a switch device disclosed in Taiwanese published patent No. 334165.
Figure 3B:
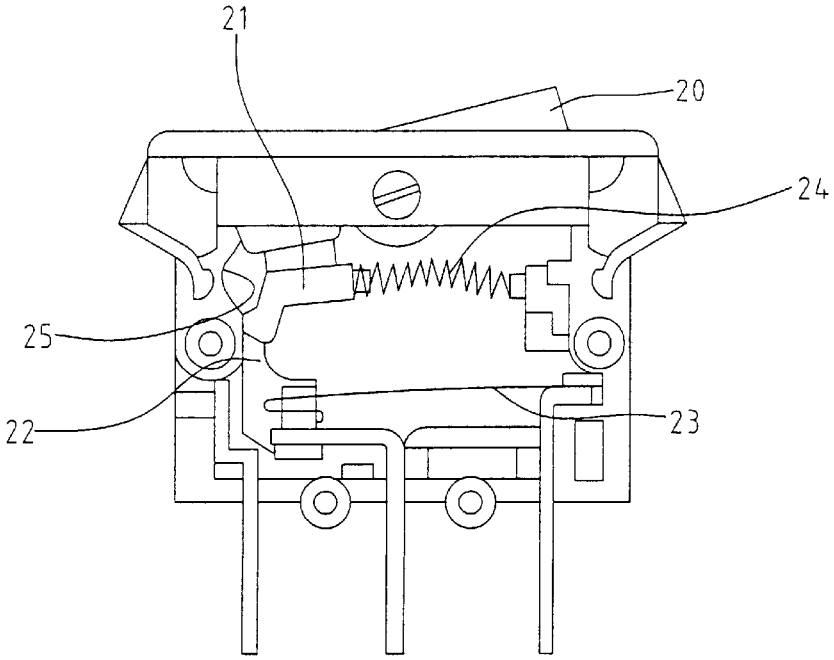
FIG. 3B PRIOR ART
Figure 4A:
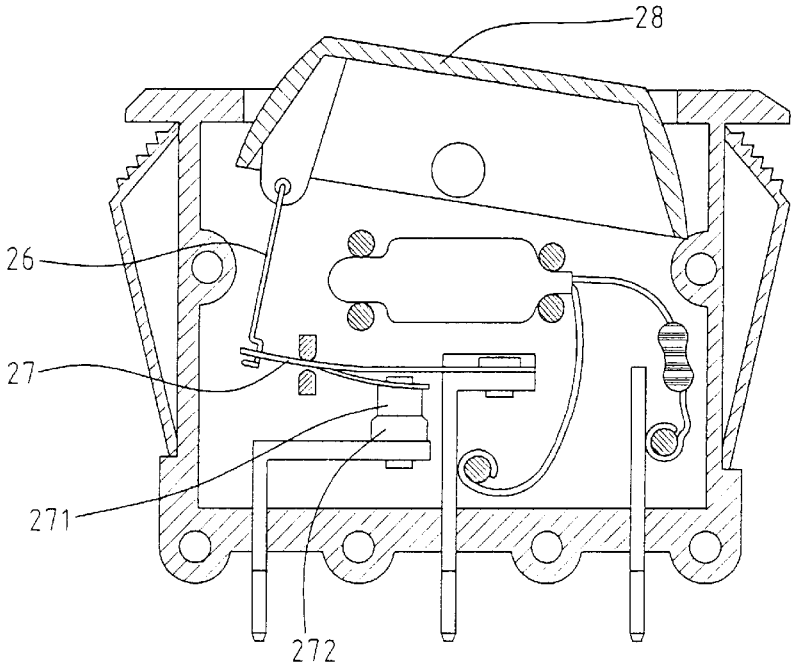
FIG. 4A PRIOR ART
FIGS. 4A, 4B and 4C show the open status and the close status of a switch device disclosed in U.S. Pat. No. 5,760,672.
Figure 4B:
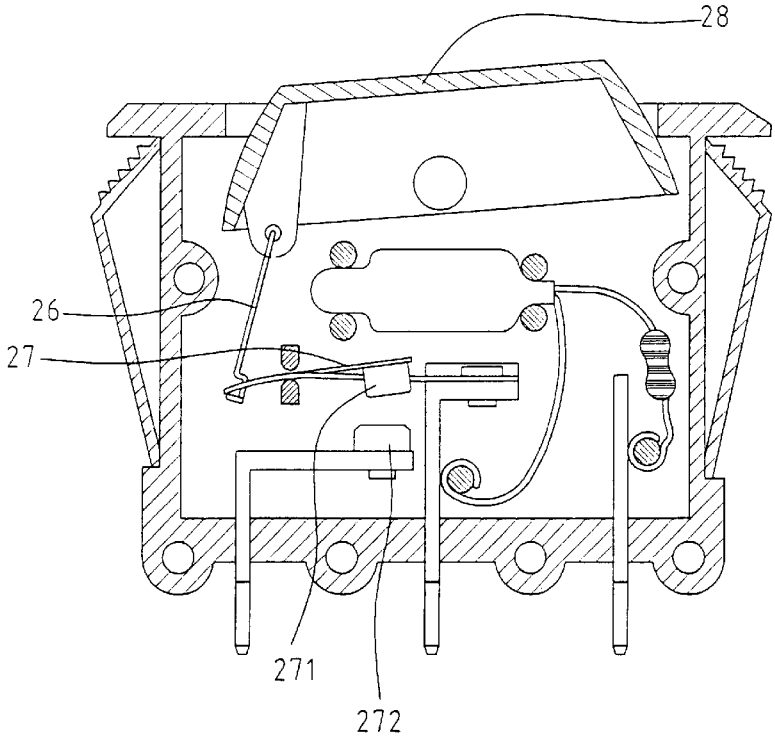
FIG. 4B PRIOR ART
Figure 4C:
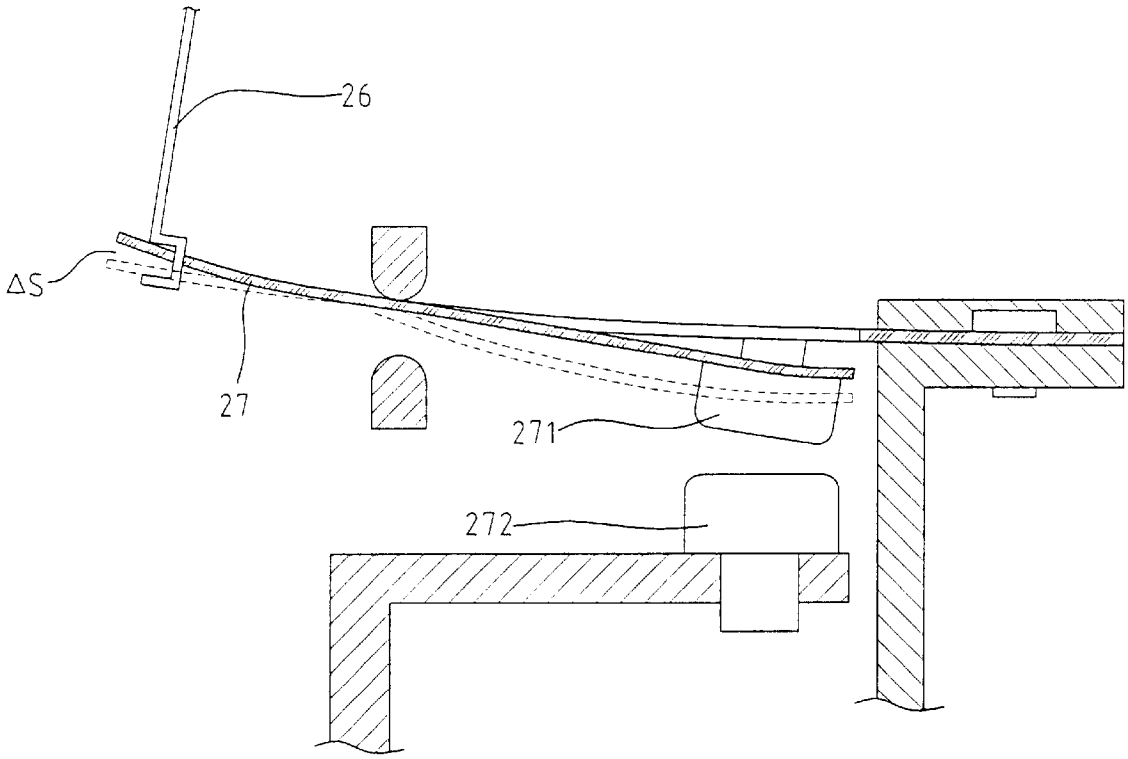
FIG. 4C PRIOR ART
Figure 5:
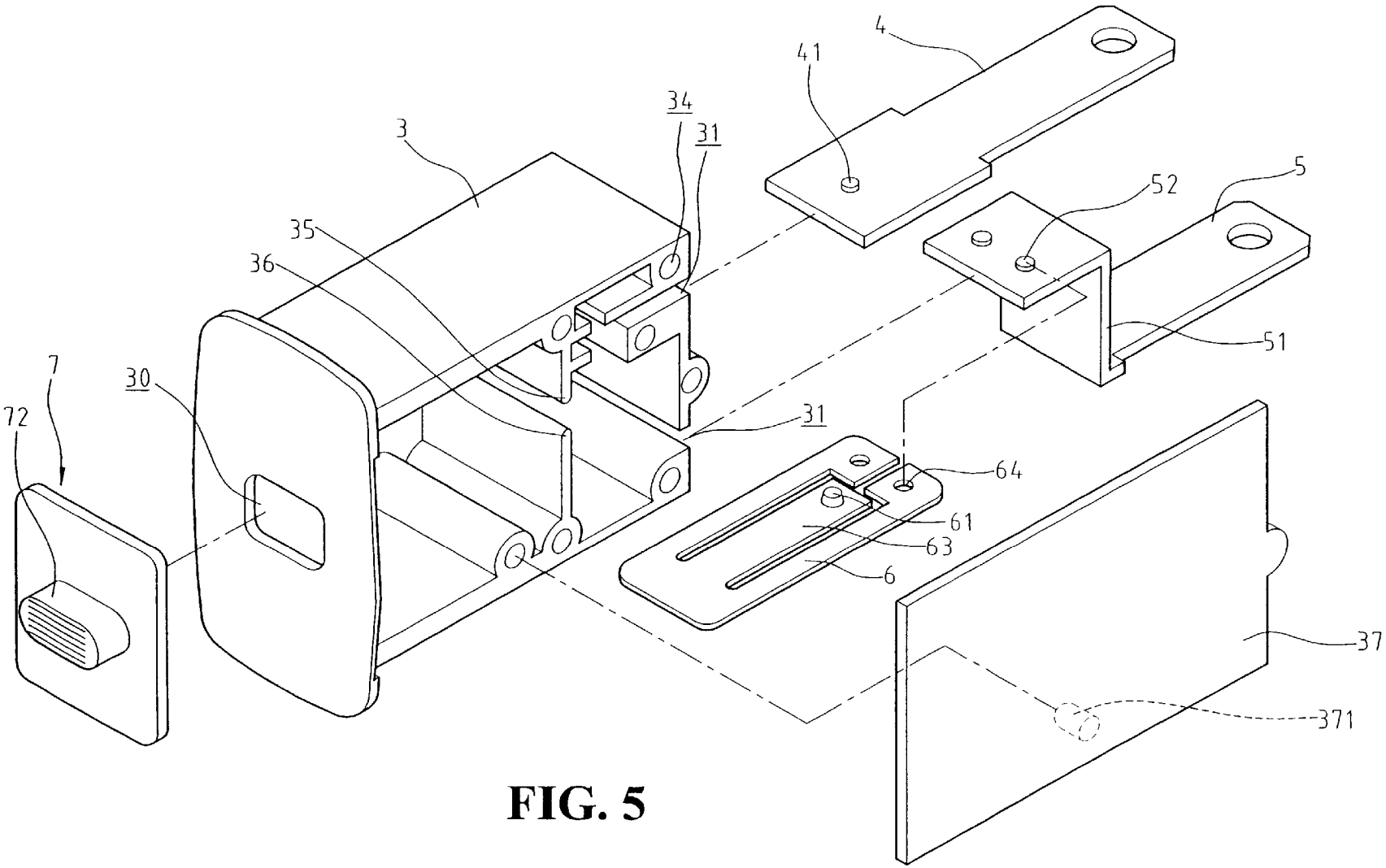
FIG. 5 is an exploded view to show a safety switch device of the present invention.
Figure 6:
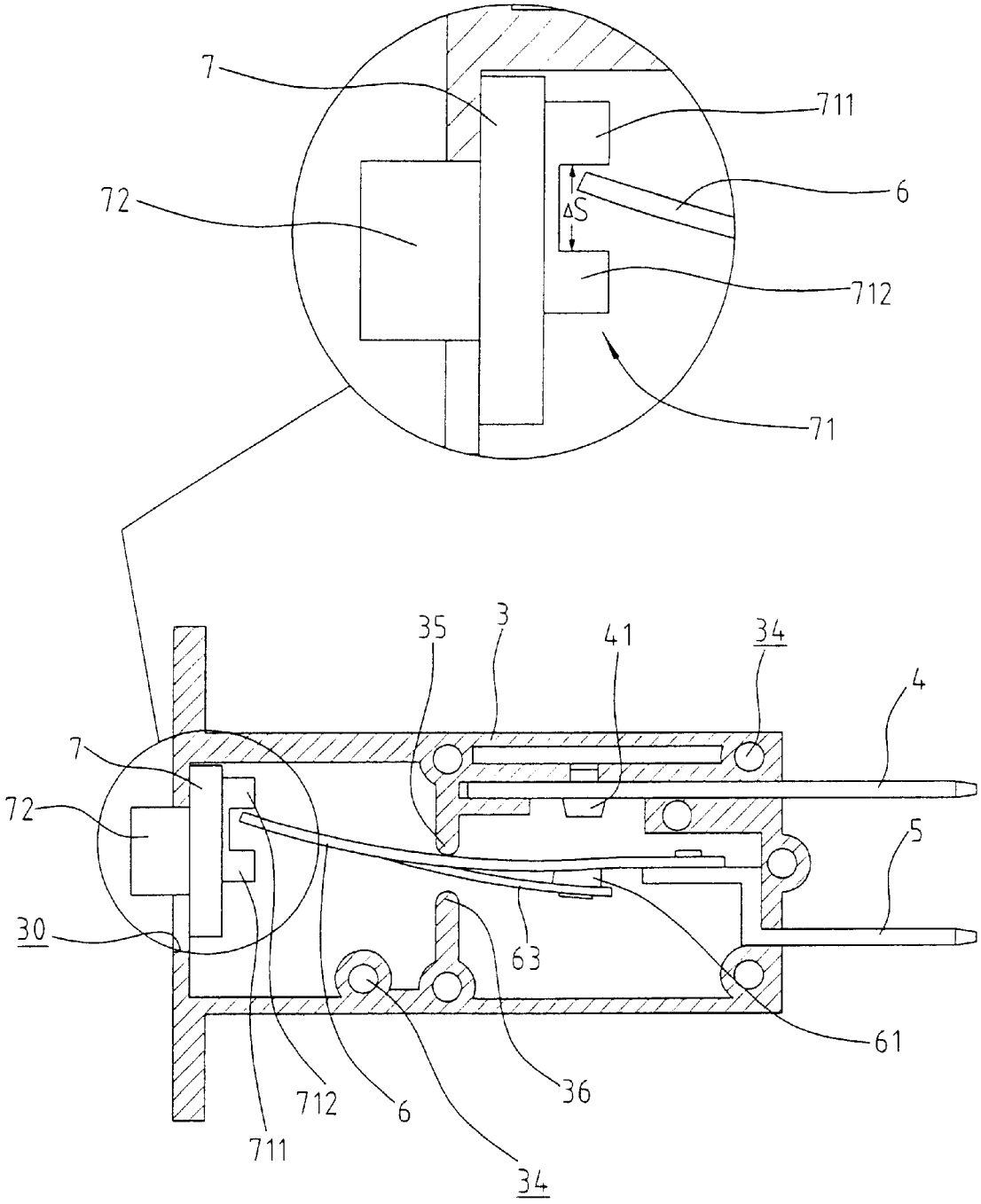
FIG. 6 is a cross sectional view to show an open status of the safety switch device of the present invention.
Figure 7:
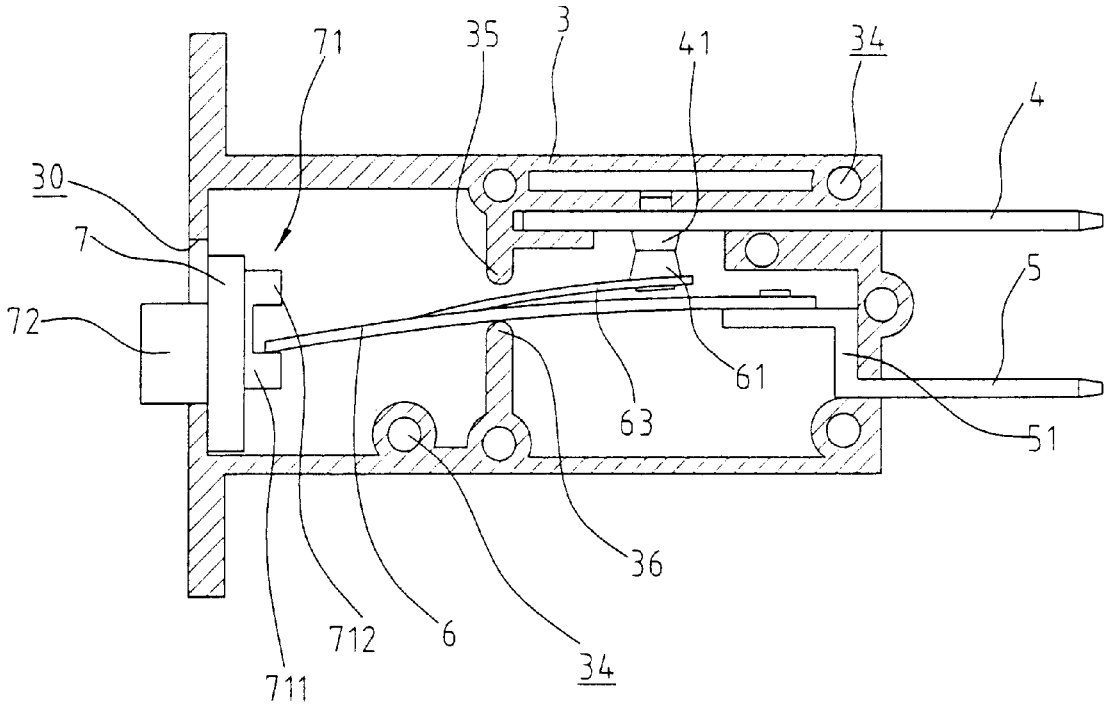
FIG. 7 is a cross sectional view to show a close status of the safety switch device of the present invention.

Referring to FIGS. 5 to 7, the safety switch device of the present invention comprises a casing 3 having two slots 31 defined in an end thereof for a first terminal plate 4 and a second terminal plate S respectively engaged therewith. A first contact point 41 is connected to the first terminal plate 4 and a bi-metal plate 6 has an end fixedly connected to the second terminal plate 5. A second contact point 61 is connected to the bi-metal plate 6. The bi-metal plate 6 includes a U-shaped portion and a tongue 63 extends from the U-shaped portion and is located between two legs of the U-shaped portion. The second contact point 61 is located on a free end of the tongue 63. The two legs of the U-shaped portion each have a hole 64 which is mounted to two bosses 52 on a stepped end 51 of the second terminal plate 5. Two ribs 35, 36 respectively extend from an inside of the easing 3 and the bi-metal plate 6 extends between the two ribs 35, 36. The two ribs 35, 36 prevent the bi-metal plate 6 from being over-deformed. A plurality of holes 34 are defined in a side of the casing 3 and a side cover 37 is connected to the side of the casing 3 by inserting position rods 371 on the side cover 37 into the holes 34.

Referring to FIGS. 10A to 10D, when mounting the two holes 64 in two legs of the bi-metal plate 6 to the bosses 52, the two legs are first pushed toward each other to narrow the width therebetween between W1 to W2. The narrower W2 allows the two holes 64 in two legs of the bi-metal plate 6 to be mounted to the bosses 52. The tongue 63 is bent upward when the circuit is a close circuit, and the tongue 63 is bent downward when the circuit is an open circuit.

A movable member 7 is movably engaged with an inside of the casing 3 and has an engaging portion 71 which comprises two protrusions 711, 712 extending from an inside of the movable member 7 so as to define a recess between the two protrusions 711, 712. One end of the bi-metal plate 6 is movably located between the two protrusions 711, 712. The casing 3 has an end hole 30 defined through an end thereof and the movable member 7 has a first block 72 extending through the end hole 30 so that the users may push the first block 72 to operate the switch device. When the movable member 7 is pushed downward, the tongue 63 is pushed upward to let the first contact point 41 contact the second contact point 61, and this is a close circuit.

Figure 8:
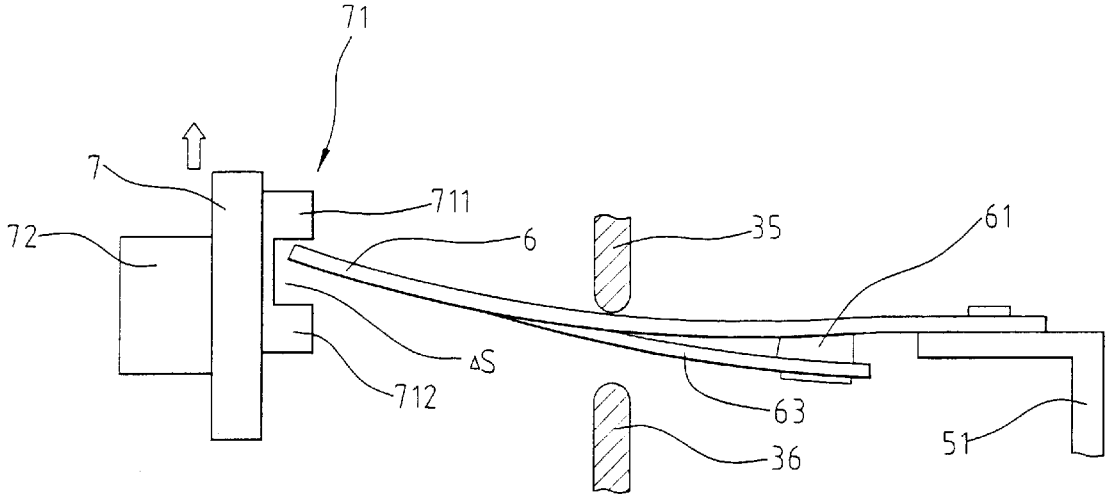
FIG. 8 is a cross sectional view to show the movable member is pulled upward by the bi-metal plate.
Figure 9:
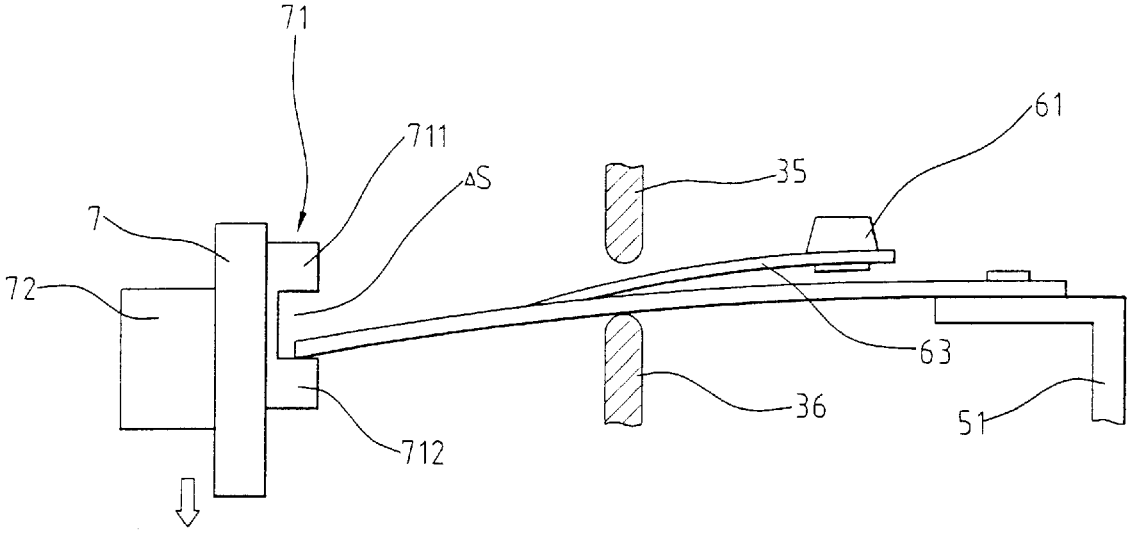
FIG. 9 is a cross sectional view to show the movable member is pushed downward to re-close the circuit.
Figure 10A:
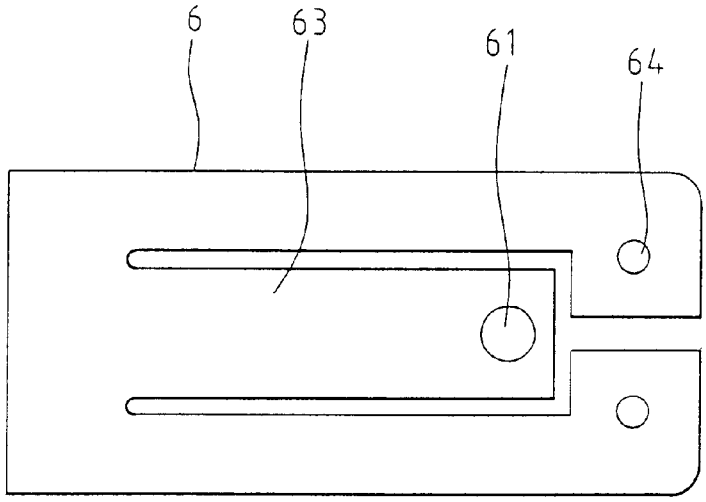
FIG. 10A shows the bi-metal plate used in the safety switch device of the present invention.
Figure 10B:
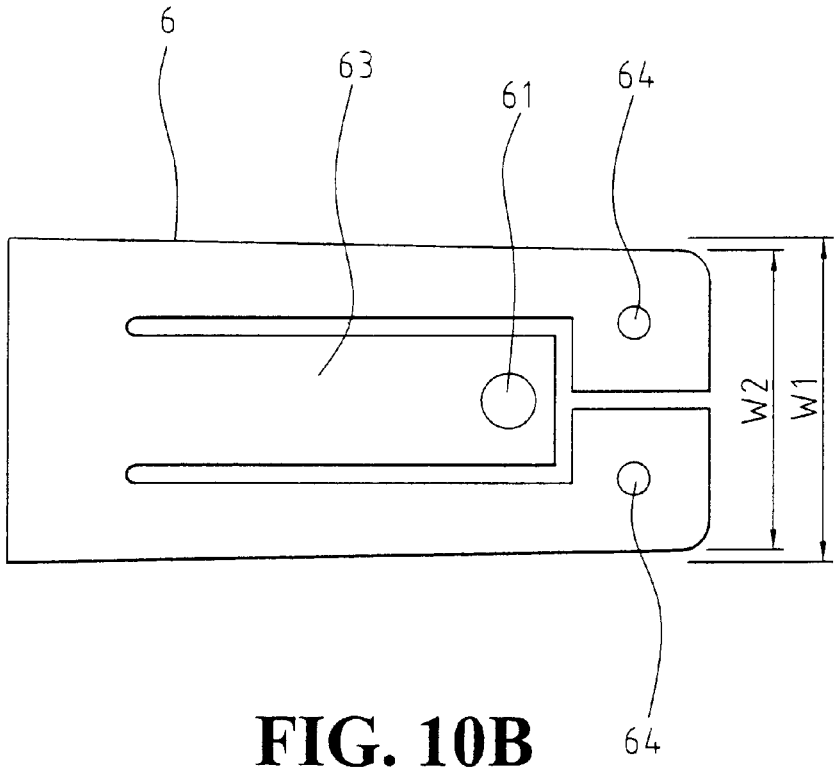
FIG. 10B shows two legs of the bi-metal plate used in the safety switch device of the present invention are pushed toward each other.
Figure 10C:
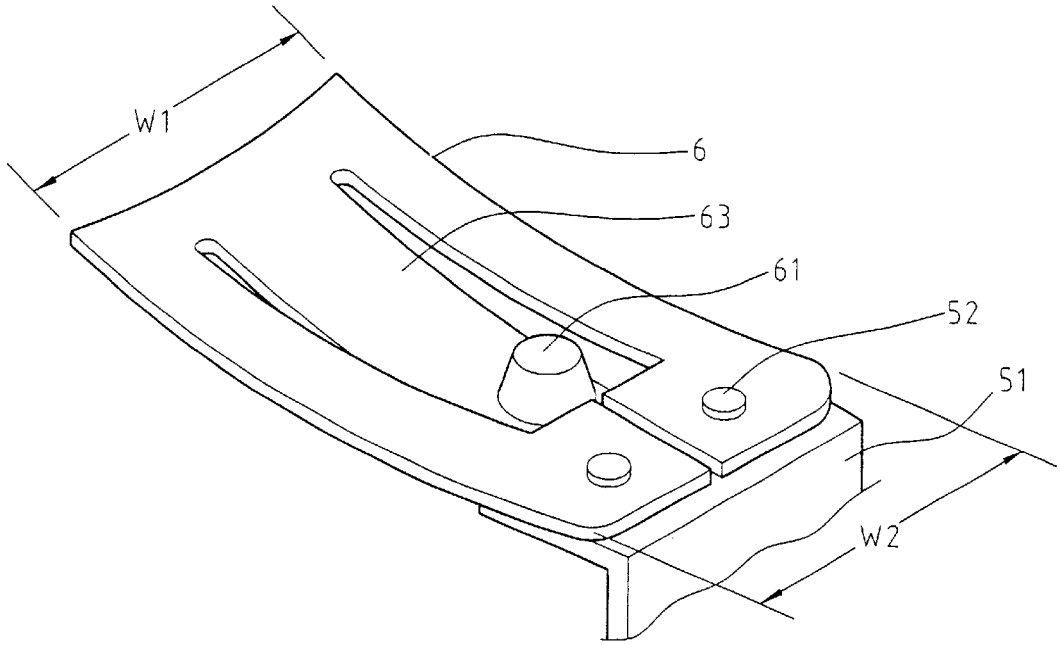
FIGS. 10C and 10D show that the tongue of the bi-metal plate used in the safety switch device of the present invention is deformed in two directions.
Figure 10D:
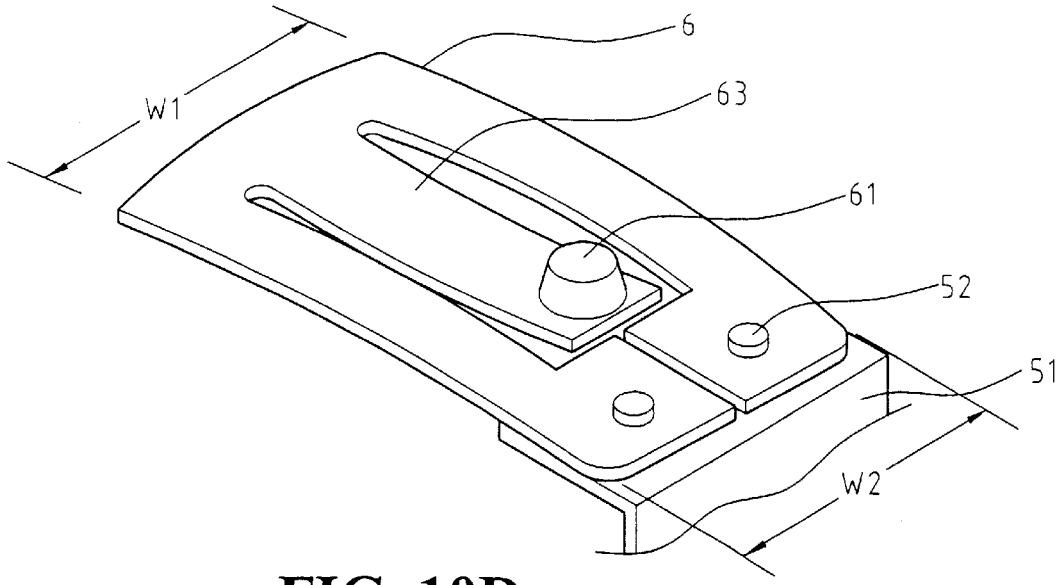
Figure 11:
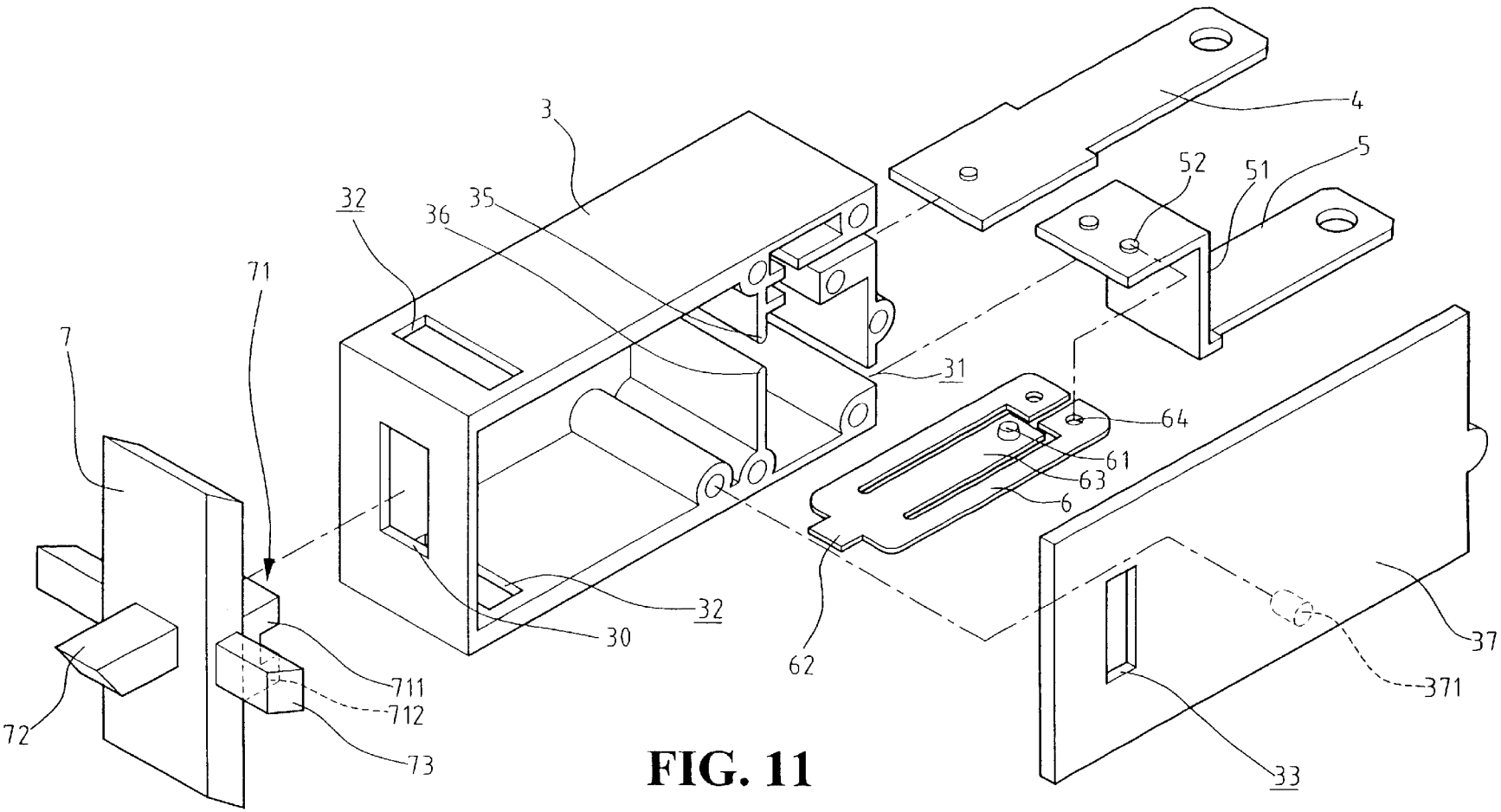
FIG. 11 is an exploded view to show another embodiment of the safety switch device of the present invention.

As shown in FIG. 8, when the current overrides, the bi-metal plate 6 is bent and the tongue 63 is bent downward to separate from the first contact point 41, and the end of the bi-metal plate 6 in the recess between the two protrusions 711, 712 is bent upward to move the movable member 7 upward. It is to be noted that the width ΔS of the recess is wide enough to allow the end of the bi-metal plate 6 to be deformed even if the movable member 7 is stuck. When the movable member 7 is pushed downward again as shown in FIG. 9, the second contact point 61 on the tongue 63 contacts the first contact point 41 again.

Figure 12:
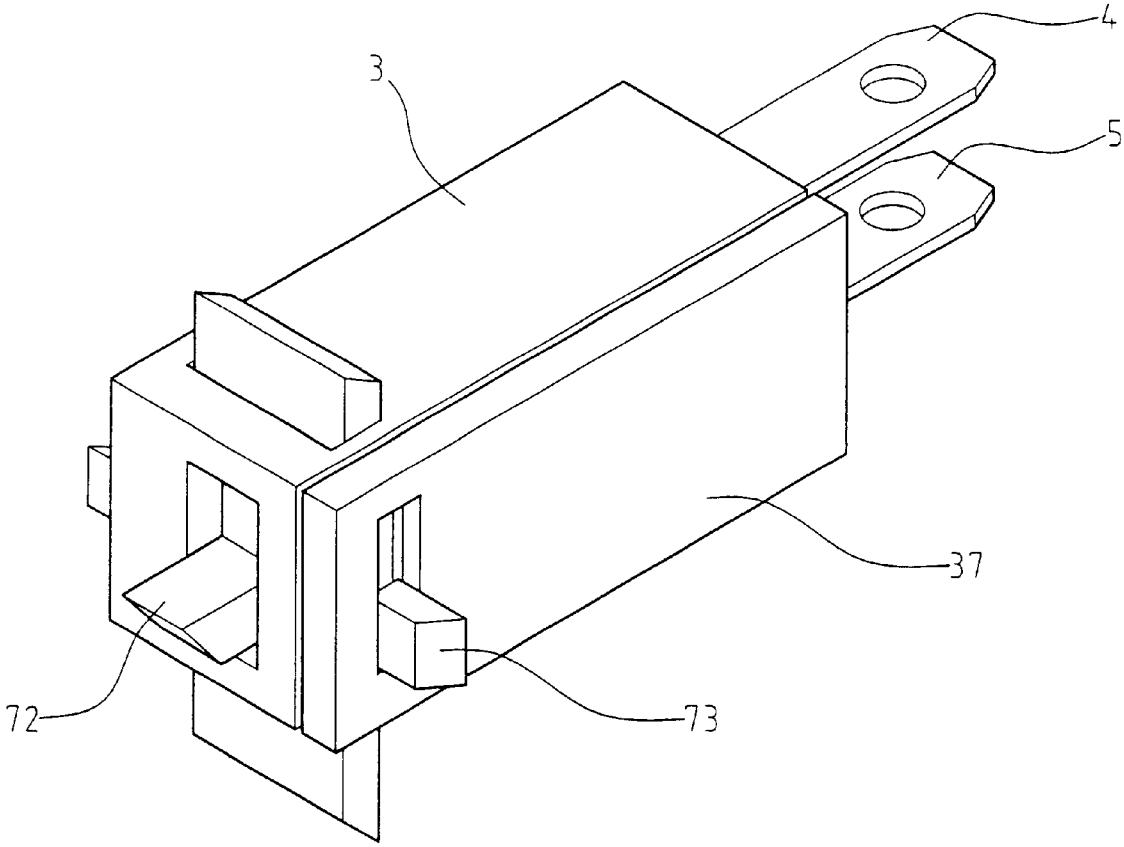
FIG. 12 is a perspective view to show the safety switch device illustrated in FIG. 11.
Figure 13:
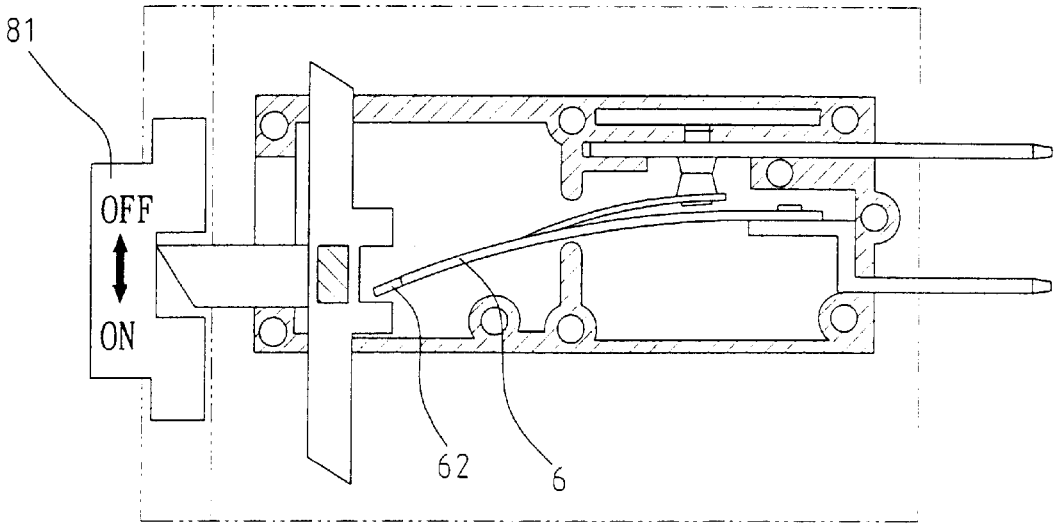
FIG. 13 is a cross sectional view to show a slide switch member is connected to the movable member of the present invention.
Figure 14:
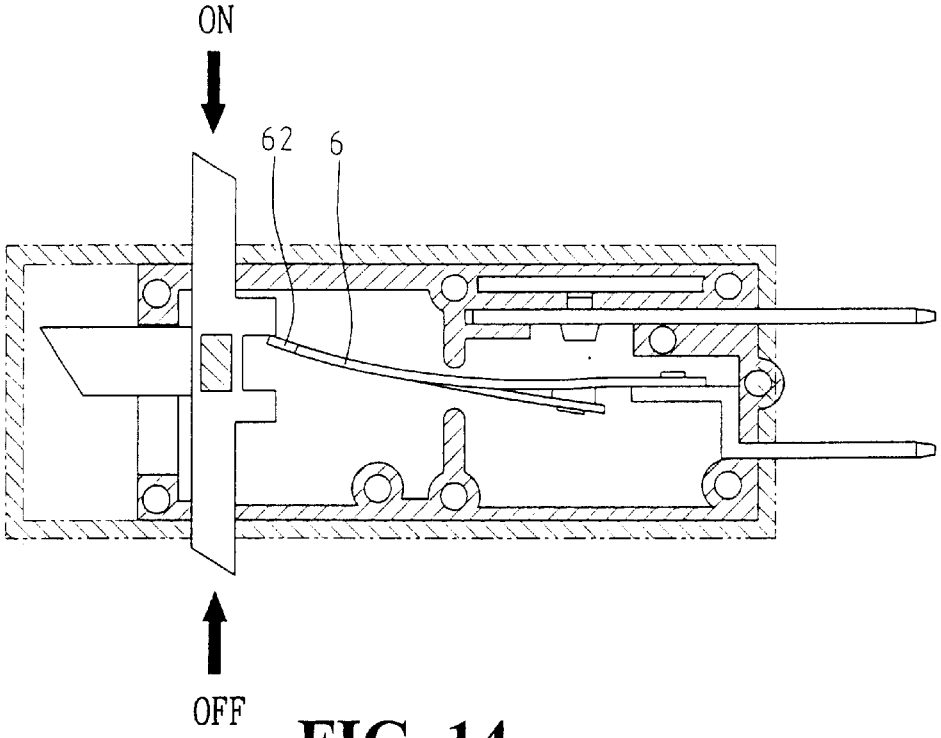
FIG. 14 shows the movable member is used as a push-type button.

Referring to FIGS. 111 and 12, the easing 3 has a top hole 32, a bottom bole 32, and two side holes 33. The bi-metal plate 6 further has an end 62. Thc movable member 7 has two side extensions 73 which respectively extend through the two side boles 33. Referring to FIG. 13, the first block 72 of the movable member 7 extends through the end hole 30 and a slide member 81 is mounted on the first block 72 so that the movable member 7 can be used as a slide switch member. As shown in FIG. 14, the users may push the top end and the bottom end of the movable member 7 to move the movable member 7 as shown.

Figure 15:
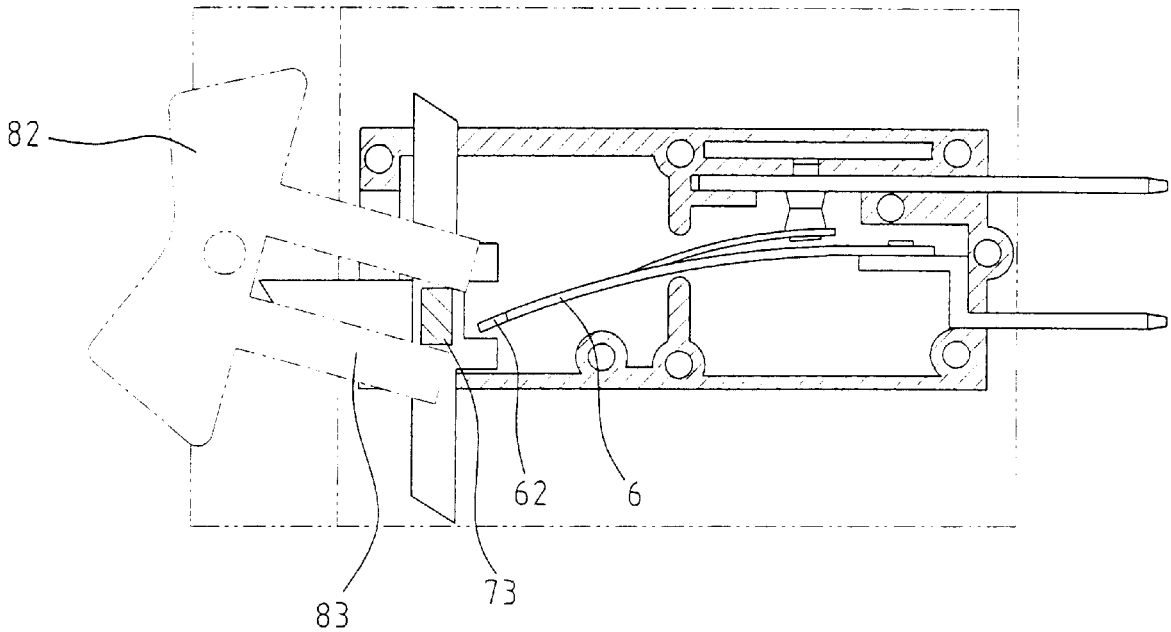
FIG. 15 shows a see-saw switch member is connected to the movable member.
Figure 16:
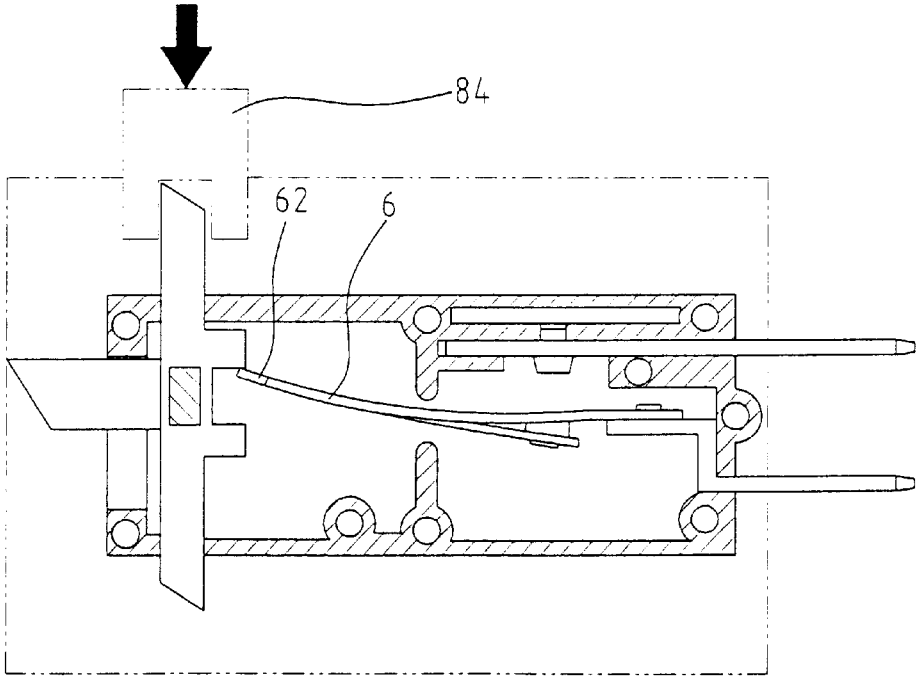
FIG. 16 shows a button is mounted to the movable member.
Figure 17:
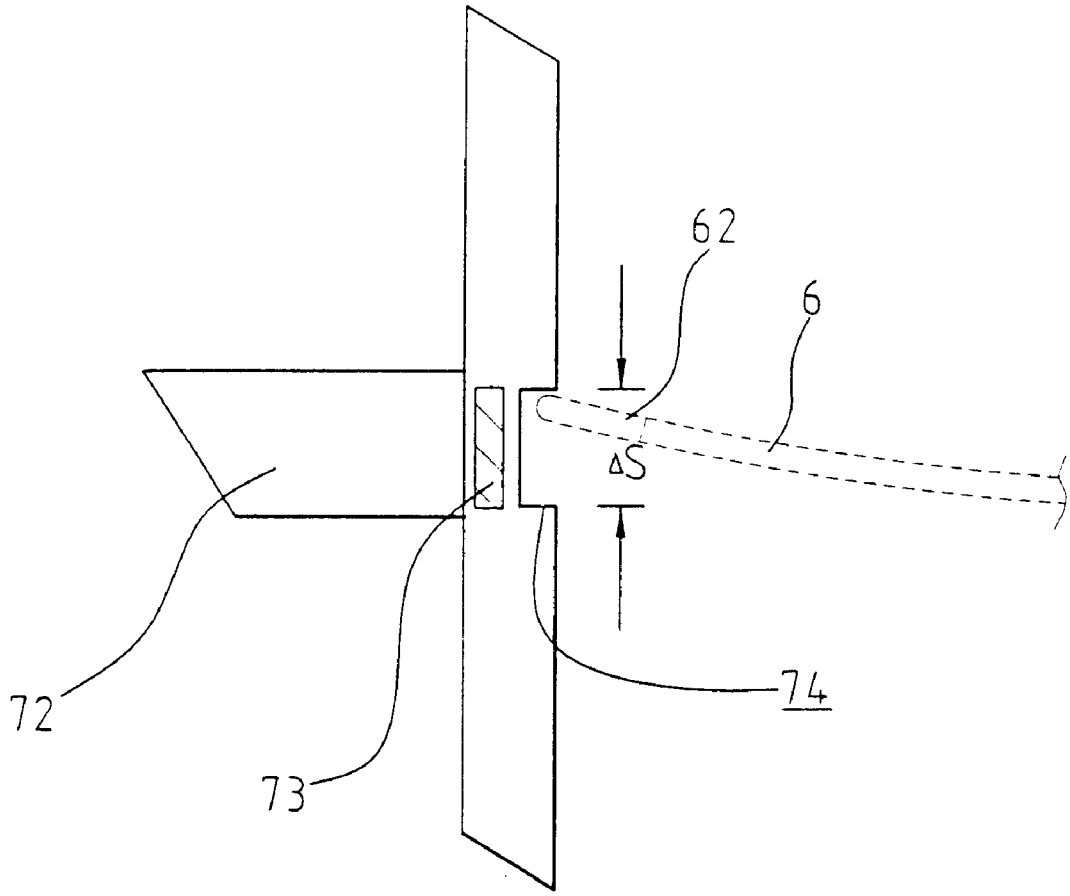
FIG. 17 shows a recess is defined in the movable member.

FIG. 15 shows a see-saw switch member 82 may be mounted to the movable member 7 by engaging two legs 83 with a side extensions 73 so that the movable member 7 is movable by operating the see-saw switch member 82. FIG. 17 shows that the recess 74 is defined in the inside of the movable member 7 without the two protrusions.

Figure 18A:
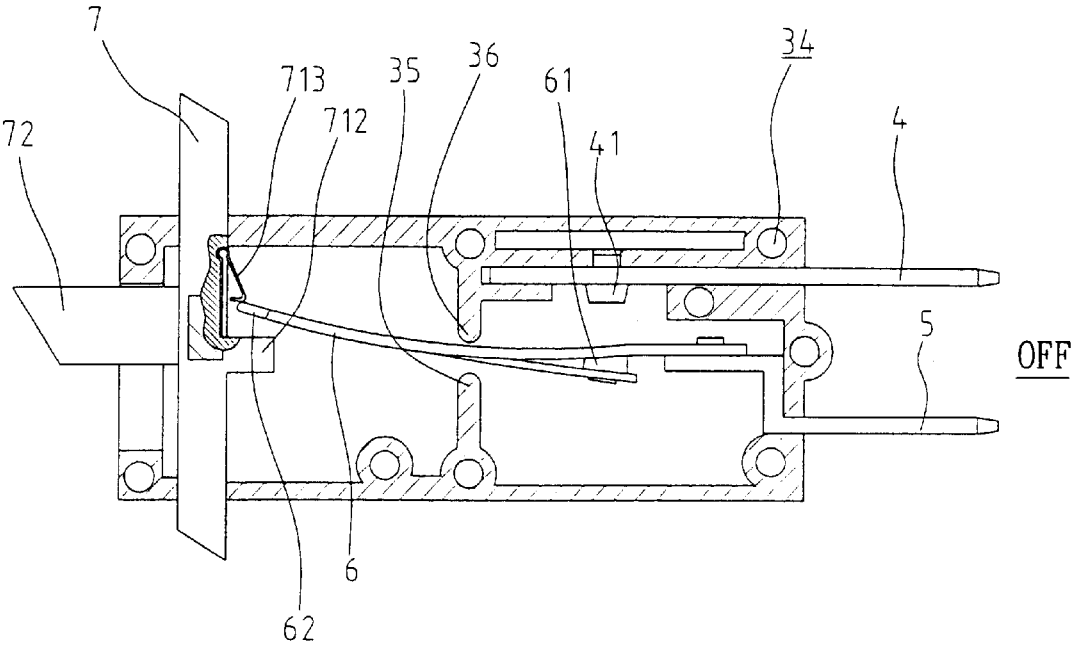
FIGS. 18A and 18B show an open status and a close status for another embodiment of the movable member.
Figure 18B:
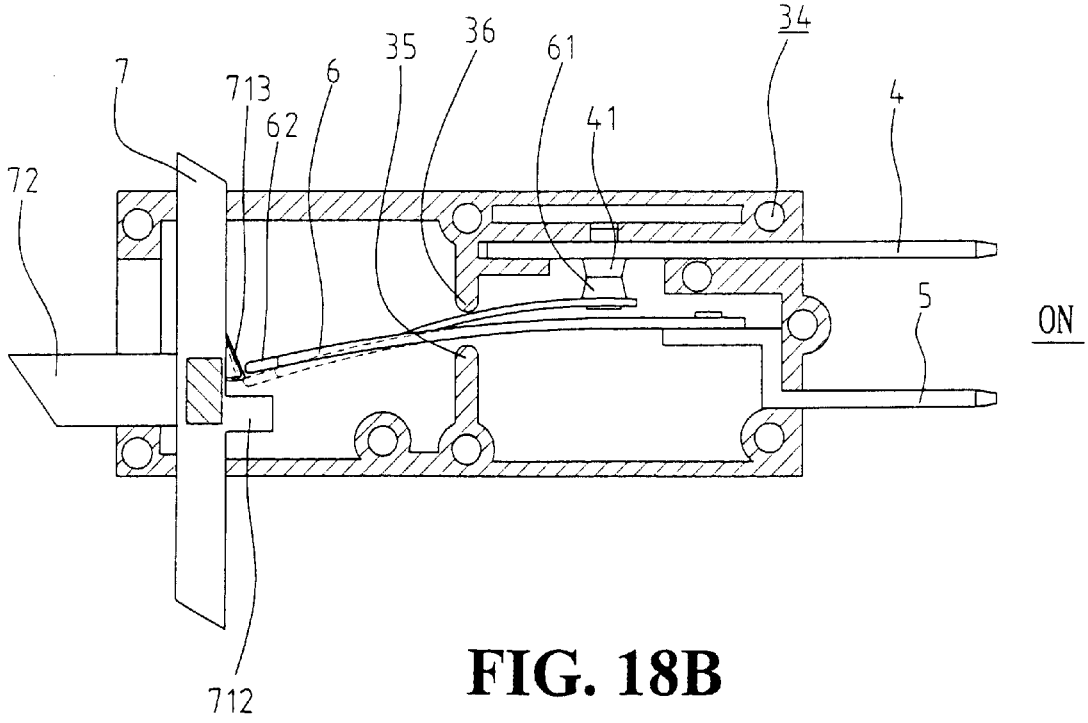
Figure 19A:
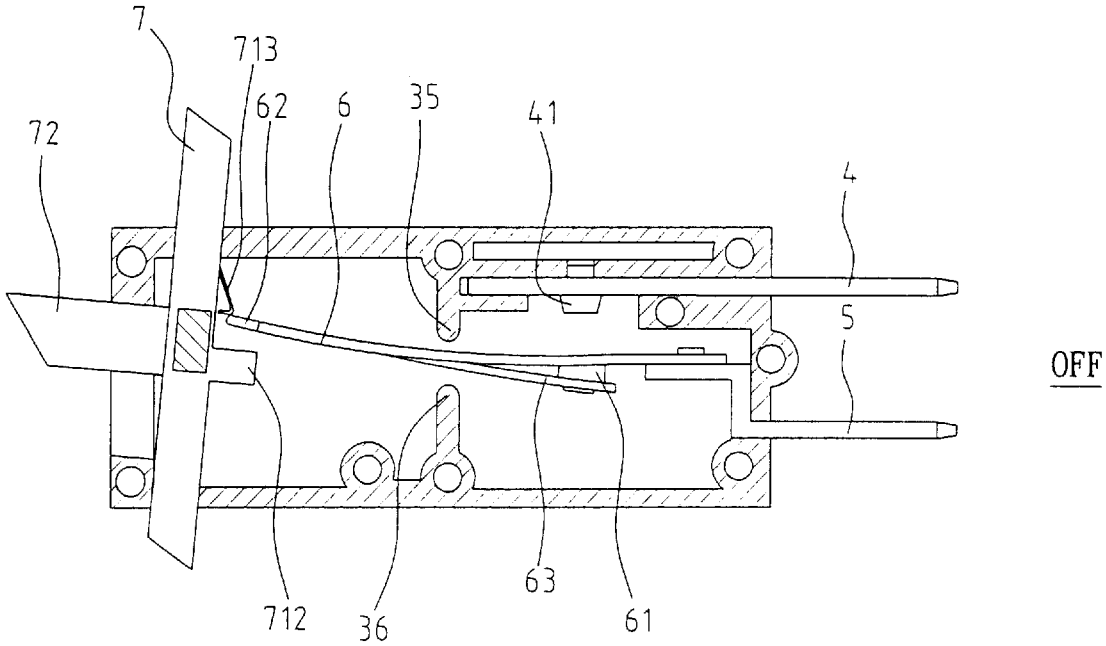
FIGS. 19A and 19B show that the movable member is installed in an inclined status.
Figure 19B:
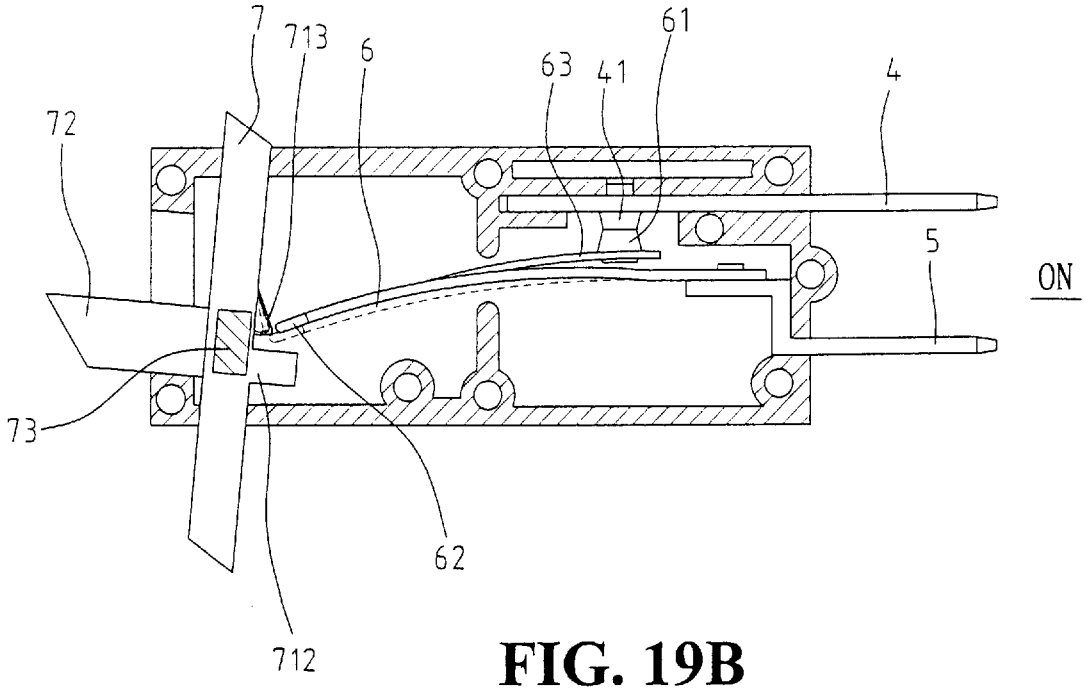

FIGS. 18A and 18B show that one of the two protrusions is a resilient plate 713 which compresses the end 62 of the bi-metal plate 6 when the circuit is an open circuit. Because the resilient plate 713 is resilient, the end 62 of the bi-metal plate 6 presses the resilient plate 713 and moves over the resilient plate 713 when the movable member 7 is pushed down. FIGS. 19A and 19B show that the movable member 7 is installed inclinedly and has the same feature as that illustrated in FIGS. 18A and 18B.

While we have shown and described the embodiment in accordance with the present invention, it should be clear to those skilled in the art that further embodiments may be made without departing from the scope of the present invention.

What is claimed is:

1. A safety switch comprising:

a casing having a first terminal plate and a second terminal plate respectively engaged therewith, a first contact point connected to said first terminal plate and a bi-metal plate having a first end fixedly connected to said second terminal plate, a second contact point connected to said bi-metal plate; and a movable member movably engaged with said casing and having a recess defined therein, said bi-metal plate having a second end movably located in said recess;

wherein said bi-metal plate includes a U-shaped portion and a tongue extended from said U-shaped portion and located between two legs of said U-shaped portion, said second contact point located on a free end of said tongue, and said two legs of said U-shaped portion each having a hole which is mounted to two bosses on said second terminal plate.

2. The safety switch as claimed in claim 1, further comprising two ribs extended from an inside of said casing, said bi-metal plate being located between said two ribs.

3. The safety switch as claimed in claim 1, wherein said casing has an end hole defined through an end thereof and said movable member has a first block extending through said end hole.

4. A safety switch comprising:

a casing having a first terminal plate and a second terminal plate respectively engaged therewith, a first contact point connected to said first terminal plate and a bi-metal plate having a first end fixedly connected to said second terminal plate, a second contact point connected to said bi-metal plate; and a movable member movably engaged with said casing and having a recess defined therein, said bi-metal plate having a second end movably located in said recess;

wherein said casing has a top hole and a bottom hole, a top end and a bottom end of said movable member respectively extending through said top hole and said bottom hole.

5. A safety switch comprising:

a casing having a first terminal plate and a second terminal plate respectively engaged therewith, a first contact point connected to said first terminal plate and a bi-metal plate having a first end fixedly connected to said second terminal plate, a second contact point connected to said bi-metal plate; and a movable member movably engaged with said casing and having a recess defined therein, said bi-metal plate having a second end movably located in said recess;

wherein said casing has two side holes and said movable member has two side extensions which respectively extend through said two side holes.

6. A safety switch comprising:

a casing having a first terminal plate and a second terminal plate respectively engaged therewith, a first contact point connected to said first terminal plate and a bi-metal plate having a first end fixedly connected to said second terminal plate, a second contact point connected to said bi-metal plate; and a movable member movably engaged with said casing and having a recess defined between two protrusions of said movable member, said bi-metal plate having a second end movably located in said recess;

wherein one of said two protrusions is a resilient plate.

* * * * *